US008596694B2

(12) United States Patent
Taurasi et al.

(10) Patent No.: US 8,596,694 B2
(45) Date of Patent: Dec. 3, 2013

(54) VEHICLE LATCH WITH SECONDARY ENGAGEMENT BETWEEN CAM AND AUXILIARY PAWL

(75) Inventors: Marco Taurasi, Leghorn (IT); Corrado Taviani, Fucecchio (IT)

(73) Assignee: Magna Closures S.p.A., Collesalvetti (IT)

( * ) Notice: Subject to any disclaimer, the term of this patent is extended or adjusted under 35 U.S.C. 154(b) by 776 days.

(21) Appl. No.: 12/553,347

(22) Filed: Sep. 3, 2009

(65) Prior Publication Data

US 2010/0052341 A1 Mar. 4, 2010

Related U.S. Application Data

(60) Provisional application No. 61/094,074, filed on Sep. 4, 2008.

(51) Int. Cl.
*E05C 3/06* (2006.01)

(52) U.S. Cl.
USPC ..... 292/201; 292/216; 292/DIG. 23; 292/304

(58) Field of Classification Search
USPC ..... 292/201, 216, DIG. 23, 304
See application file for complete search history.

(56) References Cited

U.S. PATENT DOCUMENTS

| | | | | |
|---|---|---|---|---|
| 3,594,032 | A | 7/1971 | Lampe | |
| 4,911,487 | A | 3/1990 | Rachocki | |
| 6,290,269 | B1 | 9/2001 | Bodley-Scott et al. | |
| 6,386,599 | B1 | 5/2002 | Chevalier | |
| 6,565,131 | B2 | 5/2003 | Roos | |
| 6,883,839 | B2 * | 4/2005 | Belmond et al. | 292/201 |
| 6,964,438 | B2 * | 11/2005 | Koike et al. | 292/201 |
| 7,059,640 | B2 * | 6/2006 | Tensing et al. | 292/201 |
| 2008/0224482 | A1 * | 9/2008 | Cumbo et al. | 292/216 |

* cited by examiner

*Primary Examiner* — Kristina Fulton
(74) *Attorney, Agent, or Firm* — Miller Canfield

(57) ABSTRACT

In a first aspect, the invention is directed to a vehicle latch including a ratchet, a main pawl, a cam, and at least one auxiliary pawl, wherein a secondary engagement is provided between the cam and the at least one auxiliary pawl in case a primary engagement between the cam and at least one auxiliary pawl is missed. In a particular embodiment of the first aspect, the ratchet is movable between a ratchet open position wherein the ratchet is positioned to receive a striker and a ratchet locking position wherein the ratchet is positioned to retain the striker. The ratchet is biased towards the ratchet open position. The main pawl is movable between a main pawl locking position wherein the main pawl is positioned to hold the ratchet in the ratchet locking position and a main pawl release position wherein the main pawl permits the movement of the ratchet out of the ratchet locking position. The main pawl is biased towards the main pawl locking position. The cam is operatively connected to the main pawl. The cam is movable between at least two main pawl enabling positions in which the main pawl is enabled to move to the main pawl locking position, and a main pawl disabling position in which the cam positions the main pawl in the main pawl release position. The cam is biased towards the main pawl disabling position. The at least one auxiliary pawl is movable to hold the cam in each of the at least two main pawl enabling positions and movable to permit the cam to move to the main pawl disabling position.

18 Claims, 6 Drawing Sheets

VEHICLE LATCH WITH SECONDARY ENGAGEMENT BETWEEN CAM AND AUXILIARY PAWL

This application claims the benefits of U.S. Provisional Application No. 61/094,074, filed Sep. 4, 2008.

FIELD OF THE INVENTION

The present invention relates to a closure latch for a vehicle closure panel, and more particularly to safety systems for a closure latch with a ratchet, a main pawl, a cam and an auxiliary pawl.

BACKGROUND OF THE INVENTION

Some vehicle door latches include a ratchet, a main pawl, a for controlling the position of the main pawl, and an auxiliary pawl for controlling the position of the cam. In such a latch, if a mistiming occurs between the cam and the auxiliary pawl, the cam may sweep past its intended position prior to the auxiliary pawl reaching the intended position such that they do not engage each other. In such a situation, the vehicle latch can move to a release position, thereby inadvertently releasing the striker and thereby opening the vehicle door. It is desirable to inhibit this situation from occurring.

SUMMARY OF THE INVENTION

In a first aspect, the invention is directed to a vehicle latch including a ratchet, a main pawl, a cam, and at least one auxiliary pawl, wherein a secondary engagement is provided between the cam and the at least one auxiliary pawl in case a primary engagement between the cam and at least one auxiliary pawl is missed.

In a particular embodiment of the first aspect, the ratchet is movable between a ratchet open position wherein the ratchet is positioned to receive a striker and a ratchet locking position wherein the ratchet is positioned to retain the striker. The ratchet is biased towards the ratchet open position. The main pawl is movable between a main pawl locking position wherein the main pawl is positioned to hold the ratchet in the ratchet locking position and a main pawl release position wherein the main pawl permits the movement of the ratchet out of the ratchet locking position. The main pawl is biased towards the main pawl locking position. The cam is operatively connected to the main pawl. The cam is movable between at least two main pawl enabling positions in which the main pawl is enabled to move to the main pawl locking position, and a main pawl disabling position in which the cam positions the main pawl in the main pawl release position. The cam is biased towards the main pawl disabling position. The at least one auxiliary pawl is movable to hold the cam in each of the at least two main pawl enabling positions and movable to permit the cam to move to the main pawl disabling position.

BRIEF DESCRIPTION OF THE DRAWINGS

The present invention will now be described by way of example only with reference to the attached drawings, in which.

DETAILED DESCRIPTION OF THE INVENTION

Figure 1B:
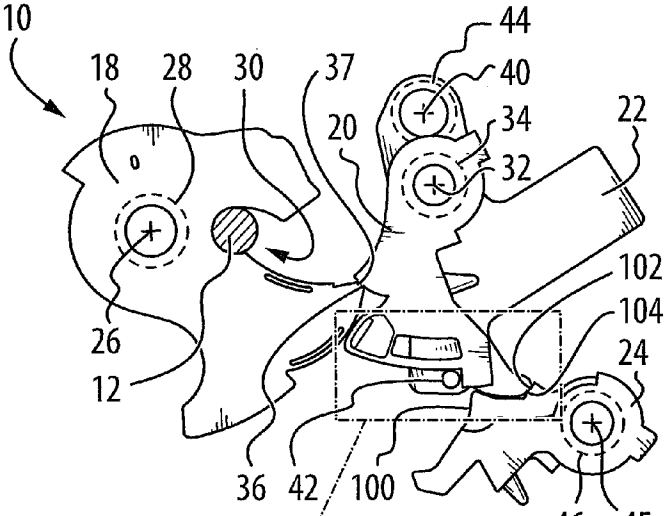
FIG. 1*b* is a plan view of the vehicle latch shown in FIG. 1*a*, showing the cam in a second main pawl enabling position.
Figure 1D:
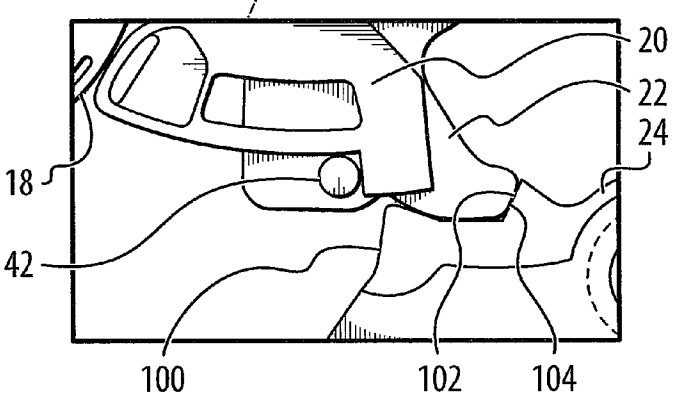
FIG. 1*d* is a magnified plan view of the vehicle latch as shown in FIG. 1*b;*
Figure 1A:
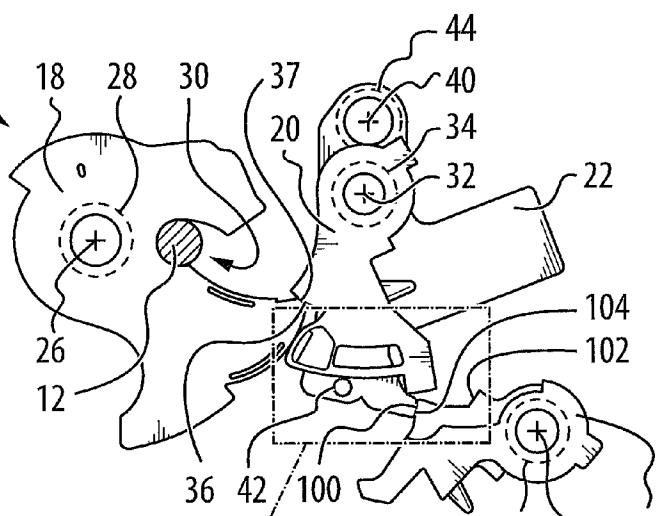
FIG. 1*a* is a plan view of a vehicle latch in accordance with an embodiment of the present invention, showing a ratchet, a main pawl, a cam in a first main pawl enabling position, and an auxiliary pawl.

Reference is made to FIG. 1*a*, which shows a vehicle latch 10 for receiving and holding a striker 12. The vehicle latch 10 may be mounted on a vehicle door (not shown), while the striker 12 may be mounted on a vehicle body (not shown).

The latch 10 includes a ratchet 18, a main pawl 20, a cam 22 and an auxiliary pawl 24. The ratchet 18 is pivotally mounted to a latch housing (not shown) the vehicle door for pivotal movement about a ratchet pivot axis shown at 26. The ratchet 18 is movable between a ratchet open position (not shown) wherein the ratchet 18 is positioned to receive the striker 12, and a ratchet locking position (FIG. 1*a*) wherein the ratchet 18 is positioned to retain the striker 12. The ratchet 18 is biased towards the ratchet open position by a ratchet biasing element 28, which may be, for example, a torsion spring.

The ratchet 18 includes a slot 30 that is configured to hold the striker 12 when the ratchet 18 is in the ratchet locking position, thereby preventing the striker 12 from being withdrawn from the ratchet 18. The slot 30 is also configured to cooperate with the striker 12 such that when the striker 12 is initially received in the slot 30, the striker 12 urges the rotation of the ratchet 18 towards its ratchet locking position.

The main pawl 20 is pivotally mounted to the cam 22 for movement about a main pawl pivot axis shown at 32. The main pawl 20 is movable between a main pawl locking position (FIG. 1*a*) wherein the main pawl 20 holds the ratchet 18 in the ratchet locking position, and a main pawl release position (FIG. 2) wherein the main pawl 20 permits the movement of the ratchet 18 out of the ratchet locking position. The main pawl 20 is biased towards the main pawl locking position by a main pawl biasing element 34, which may be, for example, a torsion spring.

The main pawl 20 includes a main pawl locking surface 36 which engages a ratchet locking surface 37 to lock the ratchet 18 in the ratchet locking position.

The cam 22 is pivotally mounted to the latch housing (not shown) about a cam pivot axis 40 for movement between a main pawl disabling position (FIG. 2) wherein the cam 22 positions the main pawl 20 in the main pawl release position, and a plurality of main pawl enabling positions (FIGS. 1*a* and 1*b*) wherein the cam 22 positions the main pawl 20 so that the main pawl 20 is movable to its main pawl locking position. A cam pin 42 on the cam 22 is used to operatively connect the cam 22 and the main pawl 20. When the cam 22 is moved to the main pawl disabling position, the pin 42 brings the main pawl 20 away from the main pawl locking position to the main pawl release position.

The cam 22 is preferably biased towards the main pawl disabling position by a biasing element 44, which may be, for example, a torsion spring.

The auxiliary pawl 24 is pivotally mounted to the latch housing (not shown) about an auxiliary pawl pivot axis 45 for movement between one or more positions wherein the auxiliary pawl 24 is positioned to hold the cam 22 in the main pawl enabling position, and an auxiliary pawl release position (FIG. 2) wherein the auxiliary pawl 24 is positioned to permit the movement of the cam 22 out of the main pawl enabling position.

The auxiliary pawl 24 is biased towards the auxiliary pawl locking position by a biasing element 46, which may be, for example, a torsion spring.

Figure 1C:
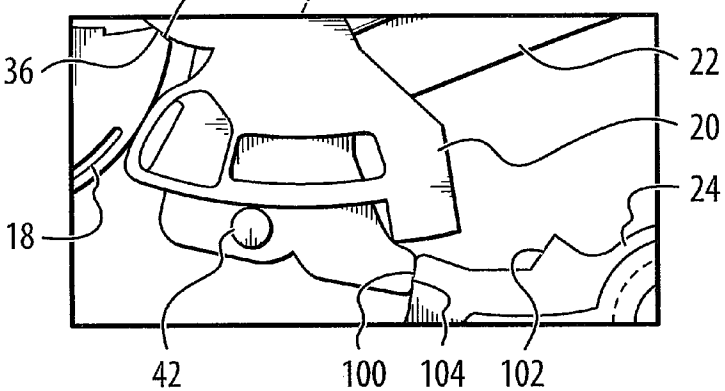
FIG. 1*c* is a magnified plan view of the vehicle latch as shown in FIG. 1*a;*

The auxiliary pawl 24 includes a first cam engagement surface 100 and a second cam engagement surface 102, which are each configured to engage an auxiliary pawl engagement surface 104 on the cam 22. More particularly, when the cam 22 is in a first main pawl enabling position, shown in FIGS. 1*a* and 1*c*, the first cam engagement surface 100 on the auxiliary pawl 24 engages the auxiliary pawl engagement surface 104 on the cam 22 and holds the cam 22 in its first main pawl enabling position. However, during closure of the latch 10 around the striker 12, it is theoretically possible for the movement of the auxiliary pawl 24 to be mistimed under certain conditions with respect to the movement of the cam 22. Thus, the cam 22 may move past its intended position, which is the first main pawl enabling position shown in FIGS. 1*a* and 1*c* before the auxiliary pawl biasing element 46 has moved the auxiliary pawl 24 to its intended position, which is the auxiliary pawl locking position shown in FIGS. 1*a* and 1*c*. As a result, the auxiliary pawl engagement surface 104 on the cam 22 may not engage the cam engagement surface 100 on the auxiliary pawl 24. In such a situation, the auxiliary pawl 24 may be moved by its biasing element 46 sufficiently quickly so that the second cam engagement surface 102 engages the auxiliary pawl engagement surface 104 on the cam 22 when the cam 22 is in a second main pawl enabling position, as shown in FIGS. 1*b* and 1*d*. Aside from a mistiming that could occur between the auxiliary pawl 24 and the cam 22 during latch closure, it is possible that, during operation of the vehicle in which the latch 10 is mounted, a sufficiently strong bump could theoretically jostle the cam 22 and auxiliary pawl 24 out of engagement and cause a mistiming between them as they are urged back towards their intended positions shown in FIGS. 1*a* and 1*c* by their respective biasing members 44 and 46. Providing the second cam engagement surface 102 on the auxiliary pawl 24 increases the likelihood of engagement between the cam 22 and auxiliary pawl 24 in the event of such mistimings.

It may be that the auxiliary pawl 24 is in a first auxiliary pawl locking position when the first cam engagement surface 100 engages the auxiliary pawl engagement surface 104 (FIGS. 1*a* and 1*c*), and in a second, different auxiliary pawl locking position when the second cam engagement surface 102 engages the auxiliary pawl engagement surface 104 (FIGS. 1*b* and 1*d*). It is alternatively possible, however, for the auxiliary pawl 24 to be in the same position when either the first or second cam engagement surfaces 100 or 102 engage the auxiliary pawl engagement surface 104.

Figure 2:
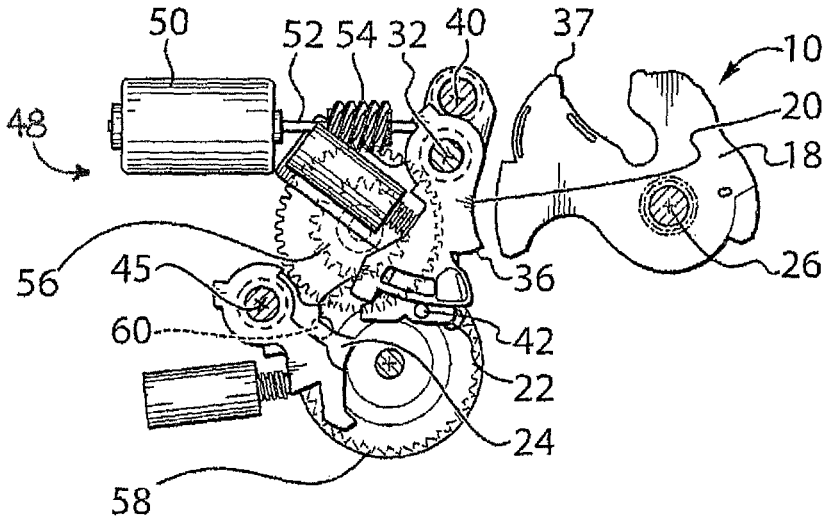
FIG. 2 is a plan view showing the vehicle latch shown in FIG. 1*a* in a release position, and showing an optional drive mechanism for use with the vehicle latch.

The latch 10 shown in the figures may include a drive mechanism 48, which may include, for example, a motor 50 with an output shaft 52, a worm gear 54 mounted on the output shaft 52, and a speed reduction arrangement of first and second spur gears 56 and 58, which are driven by the worm gear 54. The second spur gear 58 is the final gear in the drive mechanism and may thus be referred to as the final gear 58. The second gear 58 includes a drive pin 60 which is engageable with the auxiliary pawl 24 and which moves the auxiliary pawl 24 to its auxiliary pawl release position (FIG. 2). The motor 50 is thus operatively connected to the auxiliary pawl 24 to drive the auxiliary pawl 24 from the auxiliary pawl locking position (FIG. 1*a*) to the auxiliary pawl release position (FIG. 2). While a drive mechanism 48 having a motor 50 is shown in the figures, it is alternatively possible for the opening of the latch 10 to be carried out manually, using cables, rods or any other suitable mechanical elements that are directly or indirectly actuated by a user.

Figure 3B:
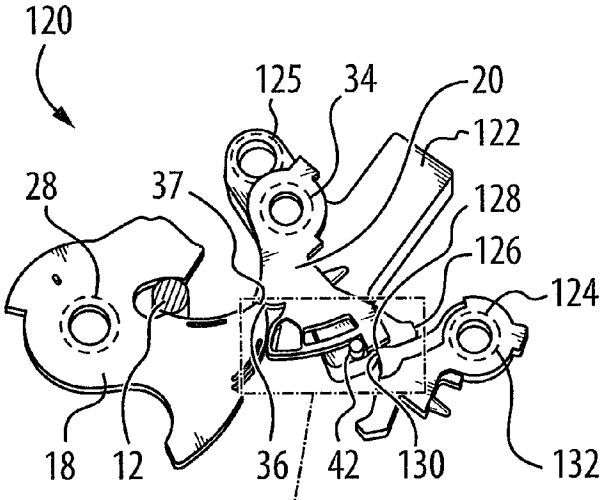
FIG. 3*b* is a plan view of the vehicle latch shown in FIG. 3*a*, showing the cam in a second main pawl enabling position.
Figure 3A:
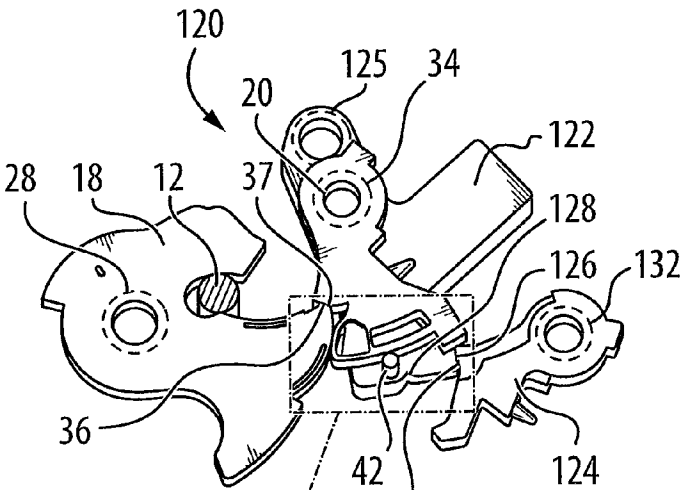
FIG. 3*a* is a plan view of a vehicle latch in accordance with another embodiment of the present invention, showing a ratchet, a main pawl, a cam in a first main pawl enabling position, and an auxiliary pawl.

Reference is made to FIG. 3*a*, which shows a latch 120 in accordance with another embodiment of the present invention. The latch 120 may include the ratchet 18, the main pawl 20, a cam 122 and an auxiliary pawl 124. The cam 122 may be similar to the cam 22 and is movable between a main pawl disabling position (not shown) and plurality of main pawl enabling positions including a first main pawl enabling position shown in FIGS. 3*a* and 3*c*, and a second main pawl enabling position shown in FIGS. 3*b* and 3*d*.

The cam 122 is biased towards the main pawl disabling position by a cam biasing element 125. The cam 122 includes a first auxiliary pawl engagement surface 126 and a second auxiliary pawl engagement surface 128, each of which is configured to engage a cam engagement surface 130 on the auxiliary pawl 124.

Figure 3D:
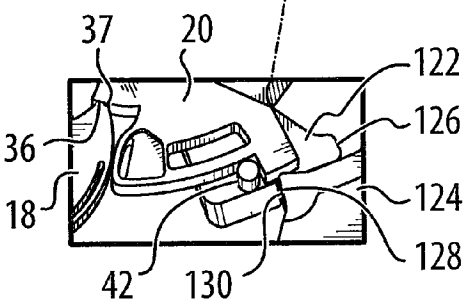
FIG. 3*d* is a magnified plan view of the vehicle latch as shown in FIG. 3*b;*
Figure 3C:
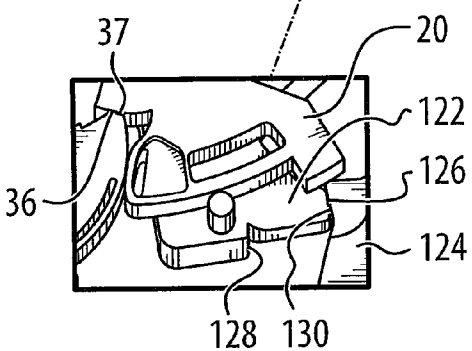
FIG. 3*c* is a magnified plan view of the vehicle latch as shown in FIG. 3*a;*

The cam engagement surface 130 on the auxiliary pawl 124 is engageable the first auxiliary pawl engagement surface 126 on the cam 122 to hold the cam 122 in its first main pawl enabling position. In at least some situations where a mistiming occurs such that the cam 22 moves past the main pawl enabling position shown in FIG. 3*a* before the auxiliary pawl biasing element 132 has moved the auxiliary pawl 24 to the auxiliary pawl locking position shown in FIG. 3*a*, the cam engagement surface 130 does not engage the first auxiliary pawl engagement surface 126 on the cam 122. Instead, if the auxiliary pawl 124 is moved sufficiently quickly by its associated biasing element 132, the auxiliary pawl 124 engages the second auxiliary pawl engagement surface 128 on the cam 122 to hold the cam 122 in a second main pawl enabling position, as shown in FIGS. 3*b* and 3*d*. Providing the second auxiliary pawl engagement surface 128 on the cam 122 increases the likelihood of engagement between the cam 122 and auxiliary pawl 124 in the event of such mistimings.

It may be that the auxiliary pawl 124 is in a first auxiliary pawl locking position when the cam engagement surface 130 engages the first auxiliary pawl engagement surface 126

(FIGS. 3*a* and 3*c*), and in a second, different auxiliary pawl locking position when the cam engagement surface 102 engages the second auxiliary pawl engagement surface 128 (FIGS. 3*b* and 3*d*). It is alternatively possible, however, for the auxiliary pawl 24 to be in the same position when the cam engagement surface 130 engages either of the first or second auxiliary pawl engagement surfaces 126 or 128.

It will be noted that a vehicle latch could be provided that incorporates a cam with first and second auxiliary pawl engagement surfaces and an auxiliary pawl with first and second cam engagement surfaces. Such a latch would thus have up to four main pawl enabling positions for the cam.

Figure 4:
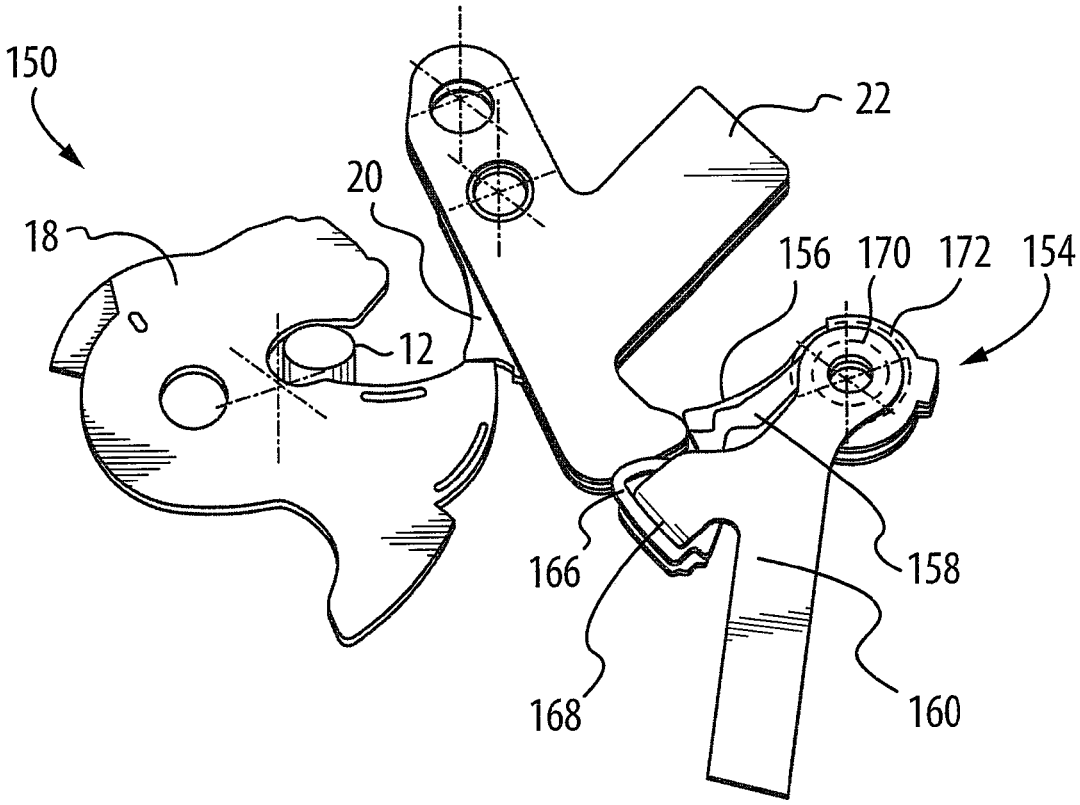
FIG. 4 is a perspective view of a vehicle latch in accordance with another embodiment of the present invention, showing a ratchet, a main pawl, a cam in a first main pawl enabling position, and an auxiliary pawl assembly.
Figure 5A:
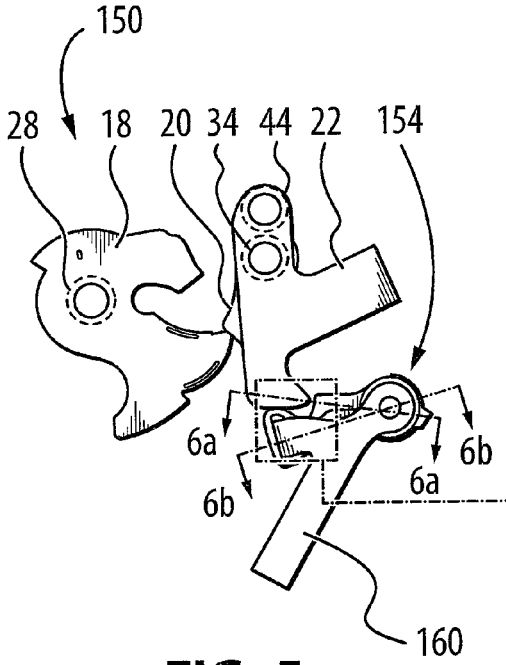
FIG. 5*a* is a plan view of the vehicle latch in the position shown in FIG. 4.
Figure 5B:
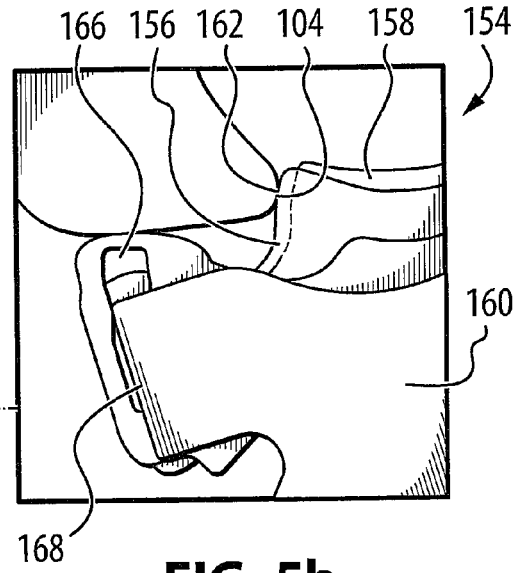
FIG. 5*b* is a plan view of the vehicle latch shown in FIG. 4, showing the cam in a second main pawl enabling position.
Figure 5C:
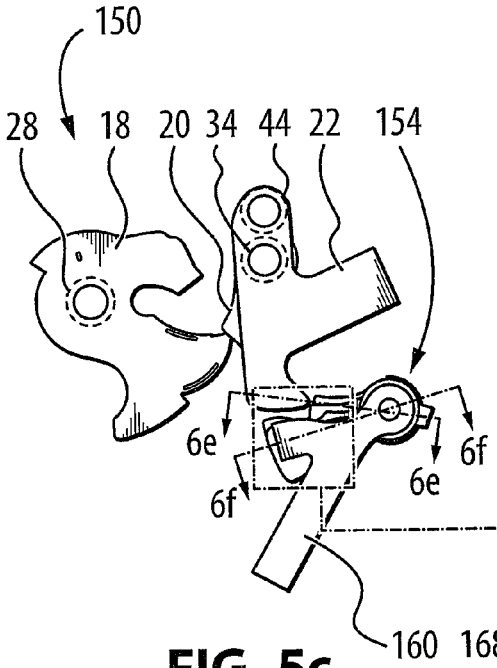
FIG. 5*c* is a magnified plan view of the vehicle latch as shown in FIG. 5*a;*
Figure 5D:
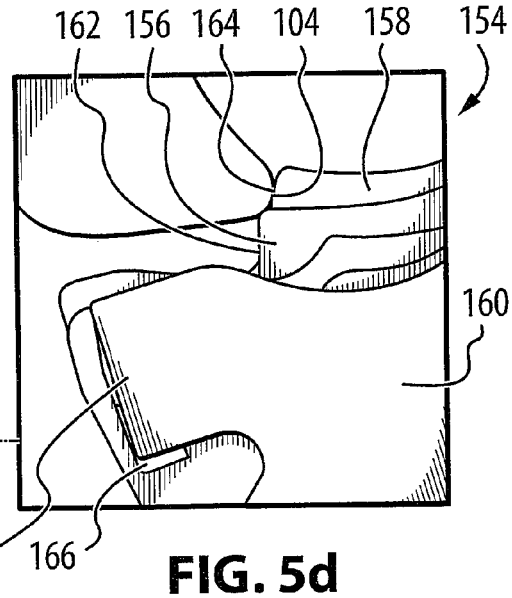
FIG. 5*d* is a magnified plan view of the vehicle latch as shown in FIG. 5*b;*

Reference is made to FIG. 4, which shows a latch 150 in accordance with another embodiment of the present invention. The latch 150 may include the ratchet 18 and the pawl 20, the cam 22 and an auxiliary pawl assembly 154. The auxiliary pawl assembly 154 includes a first auxiliary pawl 156, a second auxiliary pawl 158 and an auxiliary pawl lever 160. Referring to FIG. 5*c*, the first auxiliary pawl 156 has a first cam engagement surface 162 thereon that is positioned to engage the auxiliary pawl engagement surface 104 on the cam 22 to hold the cam 22 in a first main pawl enabling position (FIGS. 5*a* and 5*c*). Referring to FIG. 5*d*, the second auxiliary pawl 158 has a second cam engagement surface thereon 164 that is positioned to engage the auxiliary pawl engagement surface 104 on the cam 22 to hold the cam 22 in a second main pawl enabling position (FIGS. 5*b* and 5*d*).

Referring to FIGS. 5*c* and 5*d*, the first auxiliary pawl 156 includes a slot 166 in which there is positioned an auxiliary pawl engagement arm 168 of the auxiliary pawl lever 160. The arm 168 is also shown clearly in FIGS. 6*a*, 6*c*, 6*d*, 6*e*, 6*g* and 6*h*. The slot 166 is sized to permit some relative movement between the first auxiliary pawl 156 and the auxiliary pawl lever 160 between a first auxiliary pawl active position shown in FIG. 5*c* and a first auxiliary pawl bypass position shown in FIG. 5*d*. When the auxiliary pawl lever 160 is in an auxiliary pawl lever active position, shown in FIGS. 5*a*-5*d*, and the first auxiliary pawl 156 is in the first auxiliary pawl active position, shown in FIG. 5*a* and more clearly in FIG. 5*c*, the first auxiliary pawl 156 is in a first auxiliary pawl locking position. In the first auxiliary pawl locking position, the first auxiliary pawl 156 is positioned to engage the cam 22 and holds the cam 22 in its first main pawl enabling position.

The auxiliary pawl lever 160 is biased towards the auxiliary pawl lever active position shown in FIGS. 5*a*-5*d* by an auxiliary pawl lever biasing element 170 (FIG. 4), which may be, for example, a torsion spring. The first auxiliary pawl 156 is biased towards the first auxiliary pawl active position (FIG. 5*a* and more clearly in FIG. 5*c*) by a first auxiliary pawl biasing element 172 (FIG. 4), which may be, for example, a torsion spring.

Figure 6A:
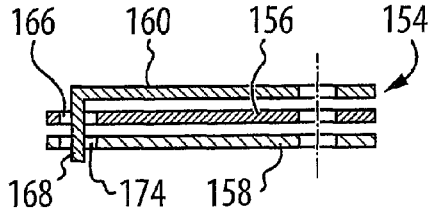
FIG. 6*a* is a sectional view of section 6*a*-6*a* in FIG. 5*a;*
Figure 6E:
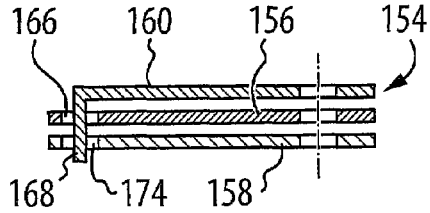
FIG. 6*e* is a sectional view of section 6*e*-6*e* in FIG. 5*b;*
Figure 6B:
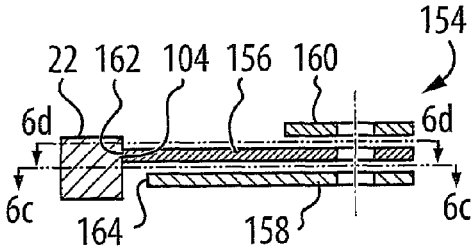
FIG. 6*b* is a sectional view of section 6*b*-6*b* in FIG. 5*a;*
Figure 6F:
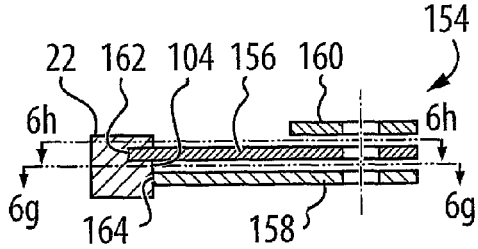
FIG. 6*f* is a sectional view of section 6*f*-6*f* in FIG. 5*b;*
Figure 6C:
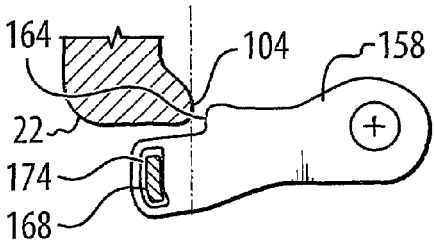
FIG. 6*c* is a sectional view of section 6*c*-6*c* in FIG. 6*b;*
Figure 6G:
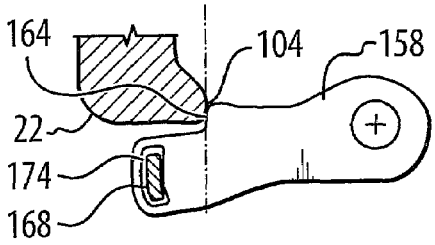
FIG. 6*g* is a sectional view of section 6*g*-6*g* in FIG. 6*f*.
Figure 6D:
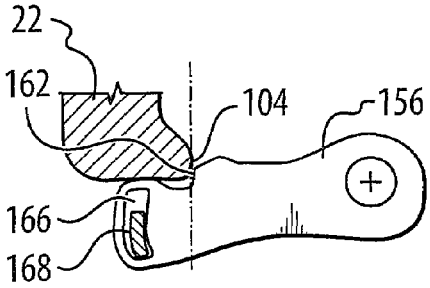
FIG. 6*d* is a sectional view of section 6*d*-6*d* in FIG. 6*b;*

The second auxiliary pawl 158 may be connected fixedly to the auxiliary pawl lever 160. Optionally, as shown in FIGS. 6*c* and 6*g*, the second auxiliary pawl 158 may have a slot 174 therein which generally snugly receives the auxiliary pawl engagement arm 168 on the auxiliary pawl lever 160. Thus, as the auxiliary pawl lever 160 moves, the second auxiliary pawl 158 with it. The auxiliary pawl lever active position (FIG. 5*a*-5*d*) corresponds to the second auxiliary pawl locking position, and the auxiliary pawl lever inactive position (not shown) corresponds to the second auxiliary pawl release position (not shown). The second auxiliary pawl 158 may be fixedly connected to the auxiliary pawl lever 160 in any suitable way, and may even be integrally connected with the auxiliary pawl lever 160. The second auxiliary pawl 158 is biased towards its second auxiliary pawl locking position under the influence of the auxiliary pawl lever biasing element 170. As a result, the auxiliary pawl lever biasing element 170 may be considered to be a second auxiliary pawl biasing element 170.

Figure 6H:
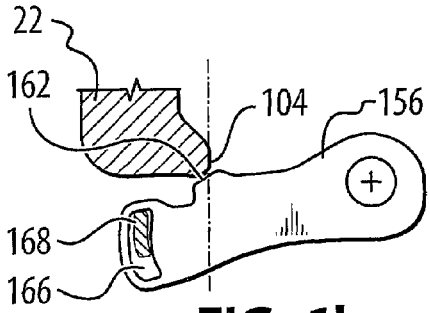
FIG. 6*h* is a sectional view of section 6*h*-6*h* in FIG. 6*f.*

In the event of a mistiming between the cam 22 and the first auxiliary pawl 156, the cam 22 may reach the first main pawl enabling position prior to the first auxiliary pawl 156 reaching the first auxiliary pawl locking position. As a result, the cam 22 will move past the first main pawl enabling position and will hold the first auxiliary pawl 156 in the first auxiliary pawl bypass position (FIGS. 5*d* and 6*h*). While the first auxiliary pawl 156 is in the first auxiliary pawl bypass position shown in FIGS. 5*c*, 5*d* and 6*h*, it does not significantly interfere with the position of the auxiliary pawl lever 160 in its auxiliary pawl lever active position, and therefore does not interfere with the position of the second auxiliary pawl 158 in its second auxiliary pawl locking position (FIGS. 5*c* and 5*d*). If the auxiliary pawl lever 160 is positioned in its active position when the first auxiliary pawl 156 misses engaging the cam 22, the second auxiliary pawl 158 will be positioned to catch the cam 22 and hold it in the second main pawl enabling position (FIGS. 5*c*, 5*d*, 6*e* and 6*f*).

Actuation of a manual or motorized drive mechanism such as one that is similar to the drive mechanism 48 (FIG. 2) moves the auxiliary pawl lever 160 to an auxiliary pawl lever inactive position (not shown) which corresponds with a first auxiliary pawl release position for the first auxiliary pawl 156 and a second auxiliary pawl release position for the second auxiliary pawl 158. When the first and second auxiliary pawls 156 and 158 are in the first and second auxiliary pawl release positions, they permit the cam 22 to move to its main pawl disabling position (not shown).

While the above description constitutes a plurality of embodiments of the present invention, it will be appreciated that the present invention is susceptible to further modification and change without departing from the fair meaning of the accompanying claims.

The invention claimed is:

1. A vehicle latch, comprising:

a ratchet rotatably movable between a ratchet open position wherein the ratchet is positioned to receive a striker and a ratchet locking position wherein the ratchet is positioned to retain the striker;

a ratchet biasing member operatively coupled to the ratchet for biasing the ratchet towards the ratchet open position;

a main pawl pivotally movable between a main pawl locking position wherein the main pawl is positioned to engage and hold the ratchet in the ratchet locking position and a main pawl release position wherein the main pawl permits the movement of the ratchet out of the ratchet locking position;

a main pawl biasing element operatively coupled to the main pawl for biasing the main pawl towards the main pawl locking position;

a cam operatively connected to the main pawl, the cam pivotally movable between at least two main pawl enabling positions in which the main pawl is enabled to move to the main pawl locking position, and a main pawl disabling position in which the cam engages and pivots the main pawl to the main pawl release position;

a cam biasing element operatively coupled to the cam for biasing the cam towards the main pawl disabling position;

at least one auxiliary pawl pivotally movable between an auxiliary pawl locking position engaged with the cam for holding the cam in each of the at least two main pawl enabling positions and an auxiliary pawl release position disengaged from the cam wherein the auxiliary pawl permits the cam to pivot to the main pawl disabling position; and an auxiliary pawl biasing element operatively coupled to the auxiliary pawl for biasing the auxiliary pawl towards the auxiliary pawl locking position engaged with the cam.

2. A vehicle latch as claimed in claim 1, wherein the at least one auxiliary pawl is one auxiliary pawl, wherein the cam includes a first auxiliary pawl engagement surface configured to engage the auxiliary pawl when the cam is in a first main pawl enabling position, and a second auxiliary pawl engagement surface configured to engage the auxiliary pawl when the cam is in a second main pawl enabling position.

3. A vehicle latch as claimed in claim 1, wherein the at least one auxiliary pawl is one auxiliary pawl, wherein the auxiliary pawl includes a first cam engagement surface configured to engage the cam when the cam is in a first main pawl enabling position, and a second cam engagement surface configured to engage the cam when the cam is in a second main pawl enabling position.

4. A vehicle latch as claimed in claim 1, wherein the at least one auxiliary pawl includes a first auxiliary pawl and a second auxiliary pawl.

5. A vehicle latch as claimed in claim 4, wherein the first auxiliary pawl includes a first cam engagement surface configured to engage the cam when the cam is in a first main pawl enabling position, and wherein the second auxiliary pawl includes a second cam engagement surface configured to engage the cam when the cam is in a second main pawl enabling position.

6. A vehicle latch as claimed in claim 5, further comprising an auxiliary pawl lever that is operatively connected to the first and second auxiliary pawls.

7. A vehicle latch as claimed in claim 6, wherein the auxiliary pawl lever is movable to an auxiliary pawl lever inactive position wherein the first and second auxiliary pawls are positioned to permit the cam to move to the main pawl disabling position.

8. A vehicle latch as claimed in claim 7, wherein the auxiliary pawl lever is movable to an auxiliary pawl lever active position wherein the first auxiliary pawl is positionable between a first auxiliary pawl locking position for holding the cam in the first main pawl enabling position, and a first auxiliary pawl bypass position wherein the cam is permitted to move past the first main pawl enabling position.

9. A vehicle latch as claimed in claim 8, wherein the first auxiliary pawl is biased towards the first auxiliary pawl enabling position.

10. A vehicle latch as claimed in claim 9, wherein the second auxiliary pawl is fixedly connected for movement with the auxiliary pawl lever.

11. A vehicle latch as claimed in claim 10, wherein the auxiliary pawl lever is biased towards the auxiliary pawl lever active position.

12. A vehicle latch as claimed in claim 1, wherein the main pawl is pivotally coupled directly to the cam.

13. A vehicle latch as claimed in claim 12, wherein the cam includes a cam pin, the cam pin engaging the main pawl to move the main pawl away from the main pawl locking position to the main pawl release position in response to moving the cam to the main pawl disabling position.

14. A vehicle latch as claimed in claim 13, wherein the at least one auxiliary pawl is one auxiliary pawl, the auxiliary pawl being movable between an auxiliary pawl release position wherein the auxiliary pawl permits the cam to move to the main pawl disabling position and an auxiliary pawl locking position to hold the cam in each of the at least two main pawl enabling positions, the auxiliary pawl being biased towards the auxiliary pawl locking position.

15. A vehicle latch as claimed in claim 14, wherein the auxiliary pawl includes a first cam engagement surface configured to engage the cam when the cam is in a first main pawl enabling position, and a second cam engagement surface configured to engage the cam when the cam is in a second main pawl enabling position.

16. A vehicle latch as claimed in claim 15, wherein the auxiliary pawl is in a first auxiliary pawl locking position when the first cam engagement surface is engaged with the cam, and wherein the auxiliary pawl is in a second auxiliary pawl locking position, different than the first auxiliary pawl locking position, when the second cam engagement surface is engaged with the cam.

17. A vehicle latch as claimed in claim 16, including a drive mechanism operatively connected to the auxiliary pawl to move the auxiliary pawl from the auxiliary pawl locking position to the auxiliary pawl release position.

18. A vehicle latch as claimed in claim 17, wherein the drive mechanism includes a motor and at least one gear, the gear having a drive pin, the drive pin engaging the auxiliary pawl to move the auxiliary pawl from the auxiliary pawl locking position to the auxiliary pawl release position.

* * * * *